United States Patent [19]

Gorick et al.

[11] 4,390,931

[45] Jun. 28, 1983

[54] LAMP ASSEMBLY

[75] Inventors: Joel C. Gorick, 10416 Windsor View Dr., Potomac, Md. 20854; Riley H. Mayhall, Jr., Burtonsville, Md.

[73] Assignee: Joel C. Gorick, Potomac, Md.

[21] Appl. No.: 168,669

[22] Filed: Jul. 11, 1980

[51] Int. Cl.[3] ..... F21V 29/00

[52] U.S. Cl. ..... 362/267; 362/306; 362/226; 362/307; 362/363

[58] Field of Search ..... 362/158, 267, 307, 226, 362/363

[56] References Cited

U.S. PATENT DOCUMENTS

| | | | |
|---|---|---|---|
| 3,688,103 | 8/1972 | Dawmüller | 362/307 |
| 3,917,939 | 11/1975 | Schmidt | 362/267 |
| 4,240,853 | 12/1980 | Pustka | 362/267 |
| 4,264,944 | 4/1981 | Deverrewaere | 362/267 |
| 4,282,565 | 8/1981 | Hanson et al. | 362/267 |
| 4,316,240 | 2/1982 | Pitkjaan | 362/267 |

*Primary Examiner*—Stephen J. Lechert, Jr.
*Attorney, Agent, or Firm*—Larson and Taylor

[57] ABSTRACT

A divisible lamp assembly which contains a replaceable light source or bulb and a sealed optical system and which provides a lighting function suitable for, but not limited to, motor vehicle lighting.

5 Claims, 3 Drawing Figures

LAMP ASSEMBLY

BACKGROUND OF THE INVENTION

This invention is in the field of lighting equipment it is more specifically directed to a new and improved lamp assembly so constructed as to provide for bulb or other light source replacement without replacing the costly lens-reflector assembly part.

Recognition of the following problems with known available lamp assemblies such as, sealed beam units, where the whole assembly must be replaced even if the optical system component is undamaged which would be costly for the component and costly for the mechanics time in demounting and remounting the whole assembly, further the cost in energy and natural resources that were used in the manufacture of the one-time use assembly, also if the optical system housing becomes broken for any reason in present day sealed beam units the filament immediately fails and the light is out which can be a safety hazard. There are also replacement light source type lamp assemblies available but the present type construction permits dirt, debrie and moisture to enter and decrease the lighting efficiency. In other words the two types of lamp assemblies available today have many disadvantages and shortcomings.

SUMMARY OF THE INVENTION

This invention is an improvement with respect to presently available lighting devices whether divisible or indivisible assemblies whereas this invention provides a sealed optical system and the feature of simple and low-cost replacement of the light source or bulb as required.

A better understanding of the invention will be achieved when the following written description of the preferred embodiment is considered in conjunction with the appended drawings.

OBJECTIVES AND ADVANTAGES

It is an object of this invention to provide a divisible lamp assembly which contains a replaceable light source of bulb means and a sealed optical system means comprized of a housing, lens, reflector means, and a light source mounting pocket, which provides a lighting function.

A further object is to eliminate costly systems used heretofore in having to replace the whole indivisible lamp assembly on failure of either the light source or the optical system.

A further object is to provide a reduction of energy used and wasted in replacement of indivisible lamp assemblies and their high maintenance costs which is achieved by simple replacement of the light source or bulb which has a short life compared to the sealed optical system which does not have to be demounted for simple bulb or light source replacement.

A further object is to provide a safer lamp assembly in that the bulb or other light source will continue to emit light even if the lens becomes broken.

The main advantage of this invention is the reduced maintenance and energy costs which is achieved by reduction of a number of potential parts that need be replaced, manufactured, stored and distributed.

BRIEF DESCRIPTION OF THE DRAWINGS

With reference to FIG. 1, the locating lugs 11 serve for locating the assembly when the assembly is installed in an automobile or the like. A rubber sealing boot 12 is provided to keep out dust and moisture. Spring clips 13 are provided for retaining the light source or bulb 50 in light source mounting pocket 40 shown in FIG. 3. The lamp assembly, of course, may be of any shape or configuration as any other suitable design which securely hold the various components in their relative position according to the specifications hereinbelow.

Figure 1:
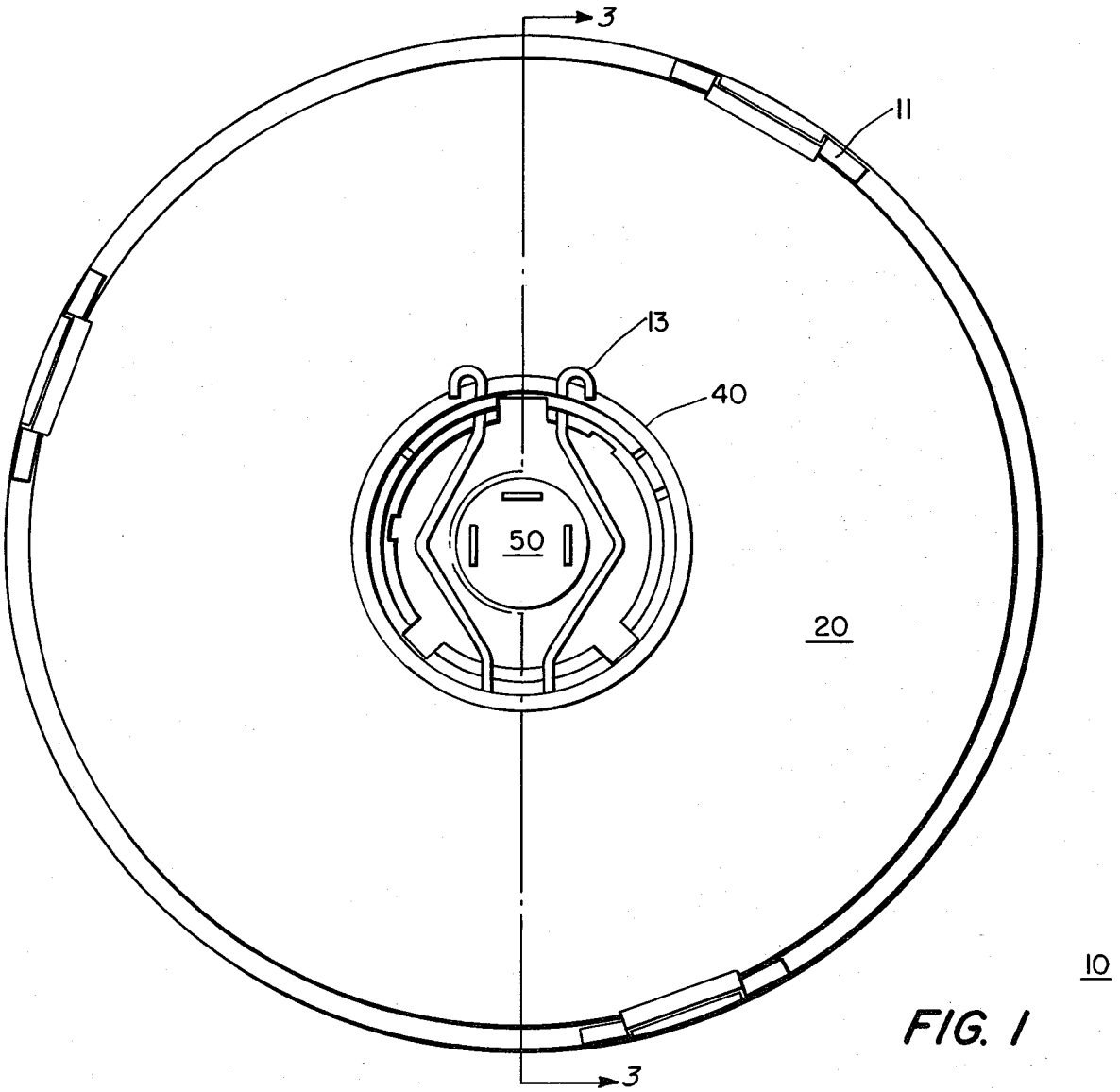
FIG. 1 is a rear elevation view of the improved lamp assembly, shown with sealing boot removed.
Figure 2:
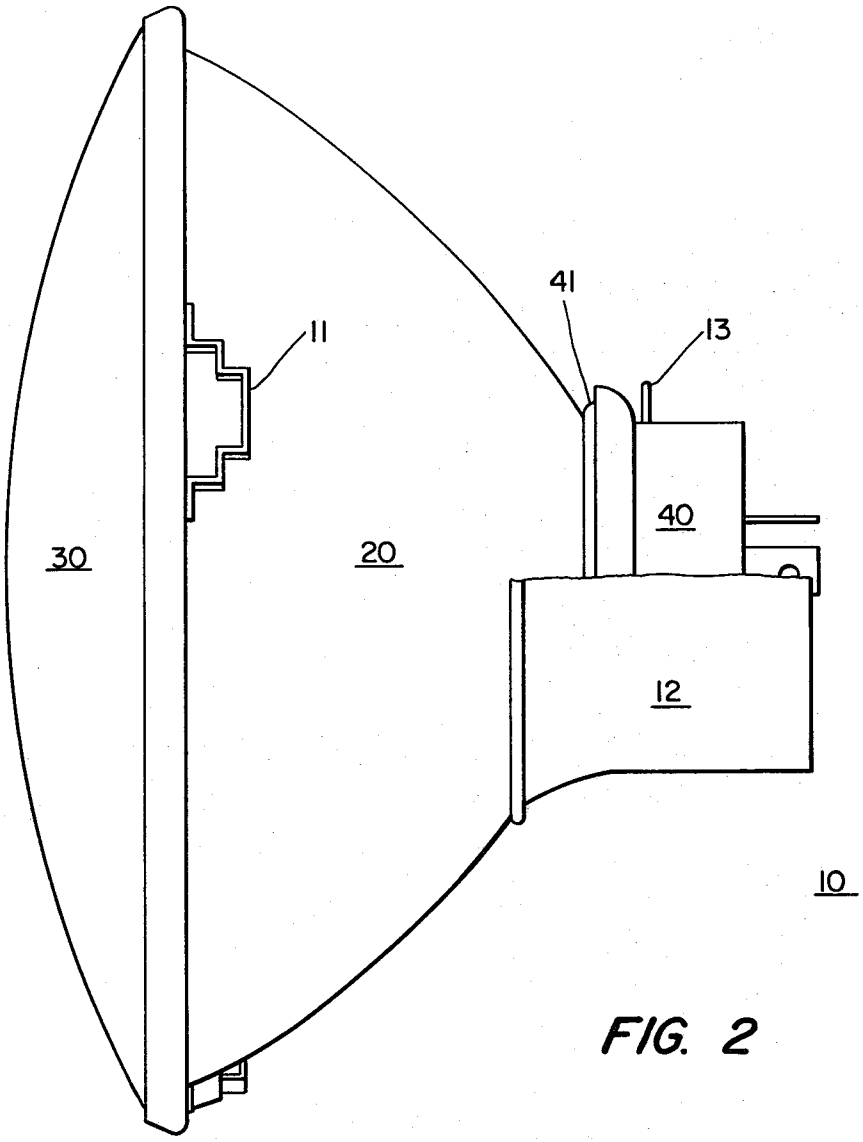
FIG. 2 is a side elevation partially sectioned view of the improved lamp assembly.
Figure 3:
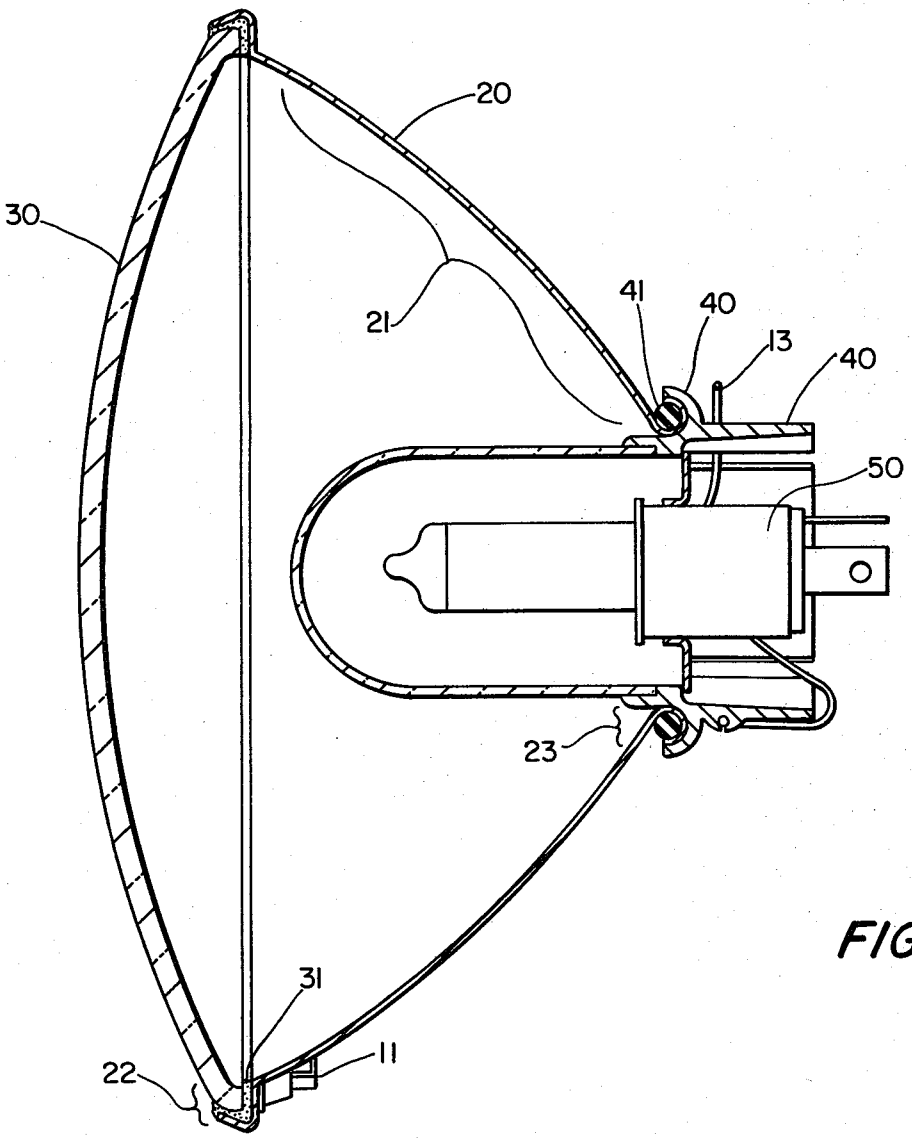
FIG. 3 is a sectional view taken along lines 3—3 of FIG. 1 showing the various parts as assembled.

As can best be seen in FIG. 3 a sectional view taken along lines 3—3 of FIG. 1 with sealing boot 12 shown in FIG. 2 removed the reflector shell 20 having an inner reflector portion 21, a front large end lens mounting portion 22, a rear small end light source socket mounting portion 23, and an assembly mounting and attaching means 24. The lens 30 is mounted to the reflector shell 20 using sealant 31 which bonds and seals lens to the reflector shell and the outer rim of reflector shell 10 may be formed around the lens 30 to ensure seal and retention. The attachment and sealing of the lens 30 to the reflector shell 20, of course, may be by any suitable means now employed in industrial processes. The light source socket 40 which is inserted into reflector shell 20, sealed by "o" ring 41 and retained either by bonding or mechanical detents provides a standard well known means for locating and retaining a light source or bulb 50 with spring clip 13. The light source socket 40 is a one piece molded part or an indivisible assembly of parts bonded together. It must be understood that the lamp assembly could be any shape such as square, rectangle or even octagon shaped and that the lamp assembly can be manufactured by many different processes well known in industry as long as the features herein specified are provided. Also the optical portion of the light source socket 40 can provide characteristics such as light diffusing or shielding as required.

We claim:

1. A lamp assembly comprising a sealed optical system including a lens, reflector and enclosed bulb mounting means so that the volume confined between the lens, reflector and bulb mounting means is hermetically sealed, said bulb mounting means comprising a cup shaped element fitted within a central opening in said reflector, at least the inner end portion of said cup shaped element being made of light transmitting material, the outer end portion of said cup shaped element being open to receive a light bulb and means for retaining a bulb within said bulb mounting means without invading the hermetically sealed volume.

2. A lamp assembly according to claim 1 wherein said last named means includes a spring clip mounted in an opening for access to the interior of the bulb mounting means.

3. A lamp assembly according to claim 1 and further including locating lugs on said lamp assembly for locating the assembly when installed.

4. A lamp assembly comprising a lens, a reflector sealed to said lens, a central opening in said reflector, a light source mounting pocket sealed in said central opening whereby said lens, reflector and light source mounting pocket form a sealed optical unit, the light source mounting pocket having at least the inner end portion made of light transmitting material and having an opening in the outer end thereof to receive a light bulb and means for releasably retaining a light bulb within the light source mounting pocket whereby the light bulb may be readily replaced without invasion of said sealed optical unit.

5. A lamp assembly according to claim 4 wherein said last named means comprises a spring means for releasably retaining a light bulb within said light source mounting pocket.

* * * * *